US005106490A

United States Patent [19]

McDonald

[11] Patent Number: 5,106,490

[45] Date of Patent: Apr. 21, 1992

[54] MOBILE MATERIAL SCREENING APPARATUS

[76] Inventor: John McDonald, Gormagh, Durrow, Tullamore, County Offaly, Ireland

[21] Appl. No.: 417,886

[22] Filed: Oct. 6, 1989

[30] Foreign Application Priority Data

Oct. 6, 1988 [IE] Ireland ..... 3028/88
Jul. 21, 1989 [IE] Ireland ..... 2368/89

[51] Int. Cl.[5] ..... B07B 1/30; B07B 1/46

[52] U.S. Cl. ..... 209/240; 209/257; 209/317; 209/420

[58] Field of Search ..... 209/240, 241, 255, 257, 209/315, 317, 319, 409, 420, 421, 935

[56] References Cited

U.S. PATENT DOCUMENTS

| | | | |
|---|---|---|---|
| 2,793,749 | 5/1957 | Wiesenthal | 209/315 |
| 3,388,797 | 6/1968 | Herman et al. | 209/317 X |
| 3,439,806 | 4/1969 | Kass et al. | 209/413 X |
| 3,647,150 | 3/1972 | Stephanek . | |
| 4,105,544 | 8/1978 | Stevick | 209/257 X |
| 4,176,066 | 11/1979 | Sloan | 209/421 X |
| 4,197,194 | 8/1980 | Read | 209/421 X |
| 4,237,000 | 12/1980 | Read et al. | 209/420 X |
| 4,256,572 | 3/1981 | Read | 209/420 X |
| 4,299,695 | 11/1981 | Bostrom . | |
| 4,303,506 | 12/1981 | Finlay | 209/421 X |
| 4,923,597 | 5/1990 | Anderson et al. | 209/420 |

FOREIGN PATENT DOCUMENTS

| | | | |
|---|---|---|---|
| 2533274 | 1/1977 | Fed. Rep. of Germany . | |
| 2627756 | 1/1977 | Fed. Rep. of Germany | 209/421 |
| 2951291 | 6/1981 | Fed. Rep. of Germany . | |
| 2567776 | 1/1986 | France . | |
| 640432 | 1/1984 | Switzerland . | |
| 1480688 | 7/1977 | United Kingdom | 209/420 |
| 2176423 | 12/1986 | United Kingdom | 209/420 |

*Primary Examiner*—Michael S. Huppert
*Assistant Examiner*—Edward M. Wacyra
*Attorney, Agent, or Firm*—Ostrolenk, Faber, Gerb & Soffen

[57] ABSTRACT

A mobile material screening apparatus includes a sloped screen box, a housing, a fifth wheel coupling, an engine and a pair of wheels fixed to the housing. Two hydraulic rams lift the apparatus and wheels off the ground and four extendable legs support it off the ground. A conveyor located underneath the screen box delivers fully screened material up over the fifth wheel coupling. A second conveyor located at the side of the apparatus removes second grade screened material. A third conveyor removes reject material which comes down a chute.

13 Claims, 5 Drawing Sheets

MOBILE MATERIAL SCREENING APPARATUS

FIELD OF THE INVENTION

The present invention relates to a mobile material screening apparatus which can be transported to a site for screening loam, gravel, debris etc.

DESCRIPTION OF THE PRIOR ART

A mobile screening apparatus is known which is provided with a trailer hitch to enable the apparatus to be towed by a tractor unit. The apparatus is provided with a pair of movable wheels remote from the trailer hitch. The wheels are movable relative to the apparatus by means of hydraulic rams to lower the apparatus to lie on the ground during operation of the apparatus and to raise the apparatus for transportation purposes. Reference may be made to U.S. Pat. No. 4,197,194 (James L. Read).

Such a mobile screening apparatus can also be provided with a conveyor which protrudes from the rear of the apparatus as disclosed in U.S. Pat. No. 4,256,572 (James L. Read). Such an arrangement is unwieldy and particularly cumbersome for transportation purposes.

A major disadvantage with the prior art apparatus is that as the apparatus, in use, does not lie on a completely flat surface, considerable vibration of the apparatus occurs during operation of the apparatus and particularly when the engine of the apparatus commences the shaking operation and when the engine is stopping. This vibration causes considerable wear on the component parts of the apparatus. Also, it is not possible to alter easily the angle of inclination of the screen located at the top of the screening apparatus. Usually, to alter this angle, operators place blocks or the like under one side of the apparatus so as to tilt the apparatus. Also, it is very difficult to clean the screen of the apparatus.

The object of the invention is to alleviate the above disadvantages.

SUMMARY OF THE INVENTION

The present invention provides a mobile material screening apparatus comprising:

- a sloped screening box mounted on the upper part of the apparatus on which material to be screened may be deposited, the screening box being sloped from a high side of the apparatus to a low side;
- wheels located at the rear of the apparatus to enable the apparatus to be moved;
- means for raising the wheels from ground contact;
- coupling means located at the front of the apparatus to enable the apparatus to be coupled to a prime mover;
- first conveyor means located beneath the screening box and extending from within the apparatus to the front of the apparatus to convey screened material from within the apparatus to the front thereof; and
- means for directing screened material from the screening box to the conveyor means.

Advantageously, the screening box comprises a first and second screening frame, the first screening frame located above and spaced apart from the second screening frame, thereby enabling three grades of screened material to be obtained from the apparatus, namely reject material, single screened material and double screened material, the double screened material being conveyed by said first conveyor means, and a

- second conveyor means is provided to convey the single screened material;
- said second conveyor means being provided at the low side of the apparatus.

Preferably, said second conveyor means is removably attached to the low side of the apparatus.

Conveniently, said second conveyor means is removably mounted above said screening box for transportation.

Advantageously, a third conveyor means is removably attached to the low side of the apparatus and is removably mounted adjacent said second conveyor means above the screening box for transportation, said third conveyor means being used to convey reject material from the apparatus.

Preferably, said wheels are fixed relative to the apparatus and said means for raising the wheels comprises at least two hydraulic rams mounted at the lower edge of the apparatus and operable to engage the ground and thereby lift the apparatus together with said wheels. Conveniently, one of said hydraulic rams is mounted at the front of the apparatus and the other of said hydraulic rams is mounted at the rear of the apparatus.

Advantageously, an extendable leg is provided at each corner of the apparatus with the extendable legs supporting the apparatus during operation.

Preferably, the mobile screening apparatus includes means for adjusting the angle of the slope of said sloped screening box.

Conveniently, the first screening frame and the second screening frame comprise removable screening magazines, each magazine comprising a screen deck having a screen mesh of the required size.

Advantageously, the screening box is agitated by means of an eccentrically mounted rotatable shaft, the shaft comprising a hollow pipe over a substantial portion of its length.

Preferably, the rotatable shaft is rotatable in a first direction and in a second direction; the first direction of rotation tending to move the material on the screening box up the slope of the screening box and the second direction of rotation tending to move the material on the screening box down the slope of the screening box.

DESCRIPTION OF THE DRAWINGS

The invention will hereinafter be more particularly described with reference to the accompanying drawings, which show by way of example only, one embodiment of a mobile screening apparatus according to the invention. In the drawings.

DETAILED DESCRIPTION OF THE PREFERRED EMBODIMENT

Figure 1:
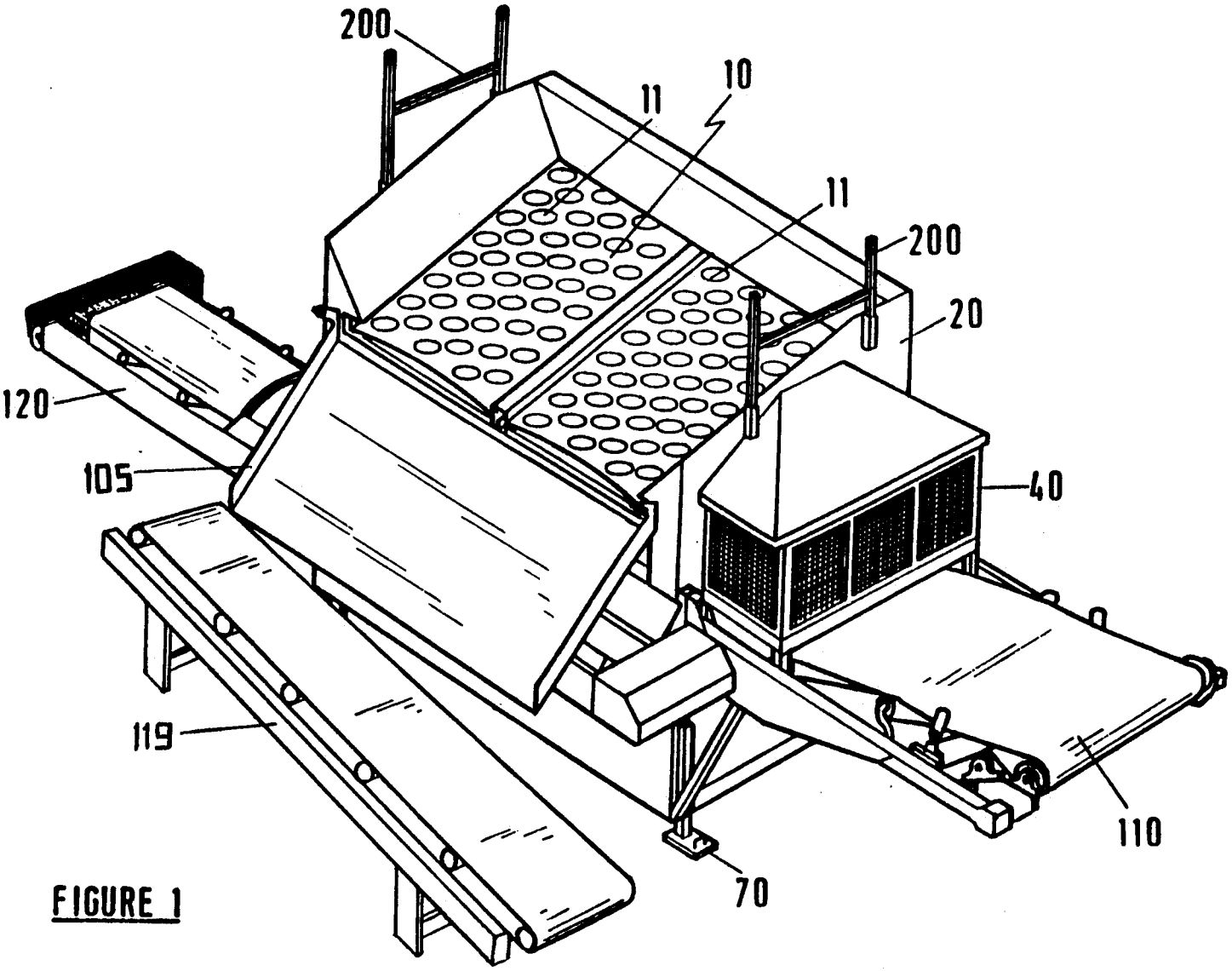
FIG. 1 is a perspective view of the apparatus in a working mode.
Figure 2:
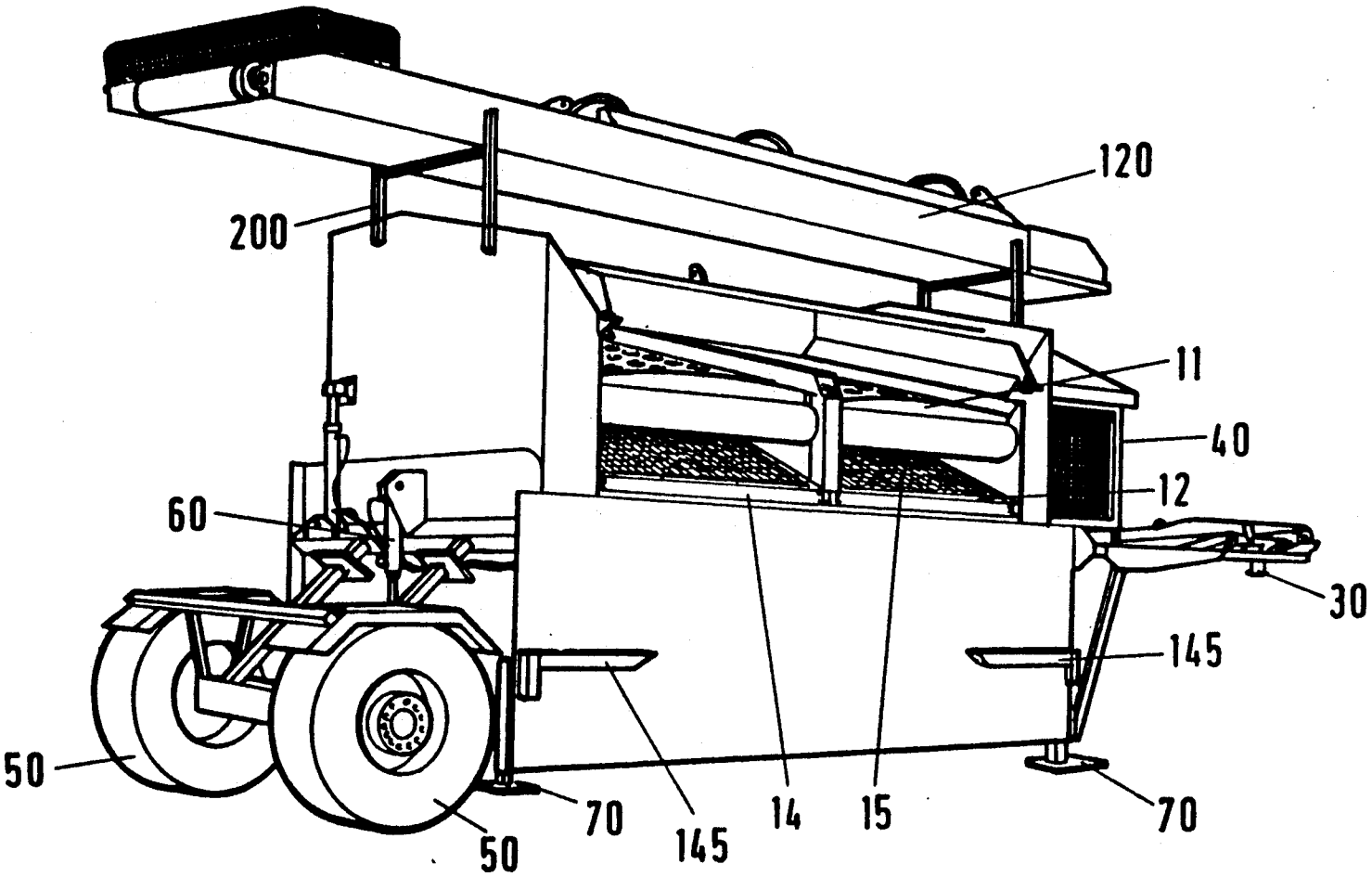
FIG. 2 is a perspective view of the apparatus in a transportation mode from one side thereof.

Referring to the drawings, the mobile screening apparatus includes a screen box 10, a housing 20, a fifth wheel coupling 30, an engine 40 and a pair of wheels 50 fixed to the housing 20. The apparatus is raised and lowered from and to ground level by two hydraulic rams 60, one of which is located at the front end of the apparatus and the other of which is located at the rear end of the apparatus.

Four stabilising legs 70 are provided at the four corners of the apparatus which are lowered to engage the ground and stabilise the apparatus.

When the rams 60 are operated to engage the ground and lift the apparatus, the legs 70 are lowered and kept in position by support pins (not shown). The rams 60 are then retracted so that the legs 70 take the weight of the apparatus. In this way, the engine 40 can be operated to shake the screen box 10 without producing much vibration.

Figure 3:
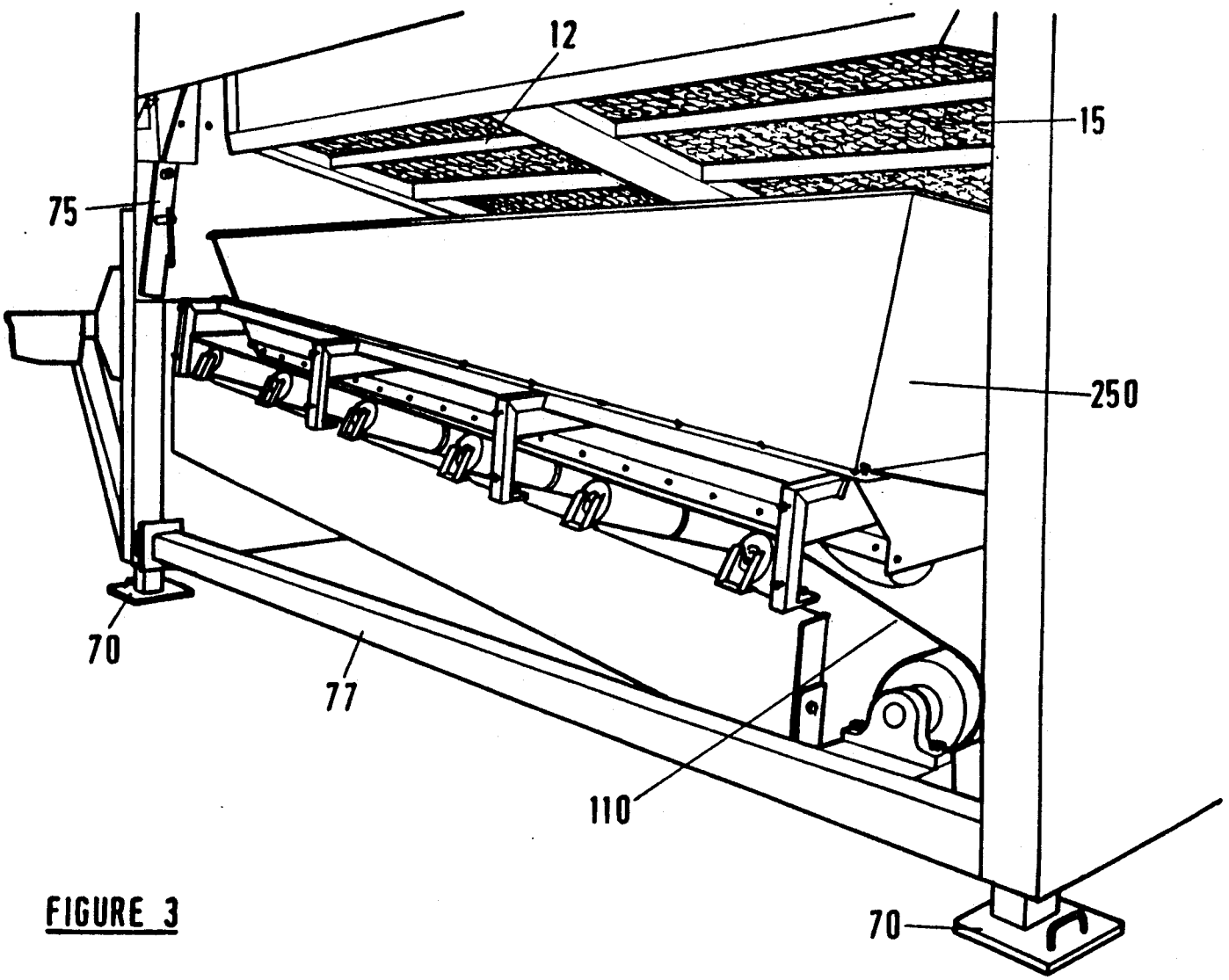
FIG. 3 is a perspective view of the apparatus from the other side thereof.
Figure 4:
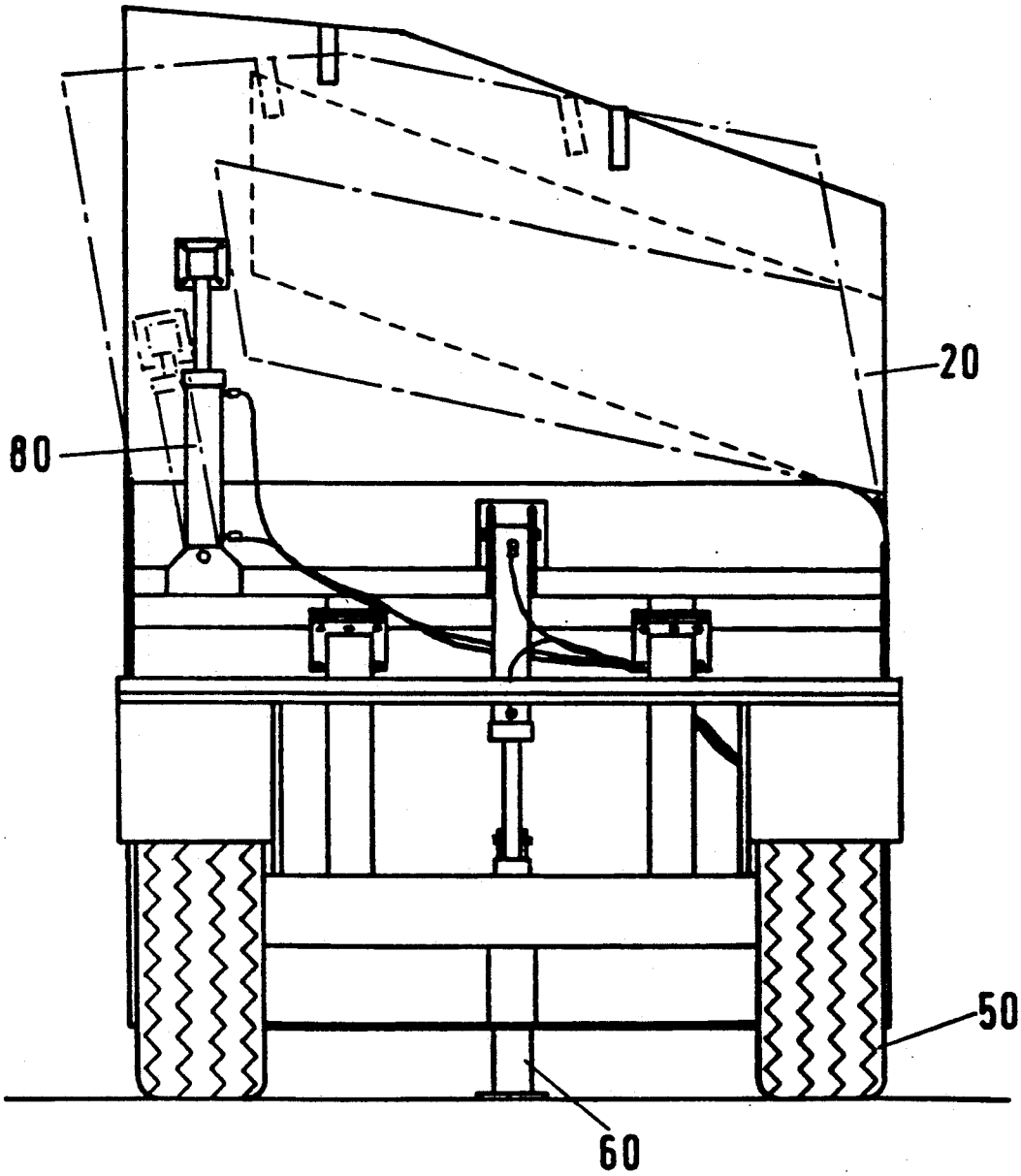
FIG. 4 is a rear view of the apparatus.
Figure 4A:
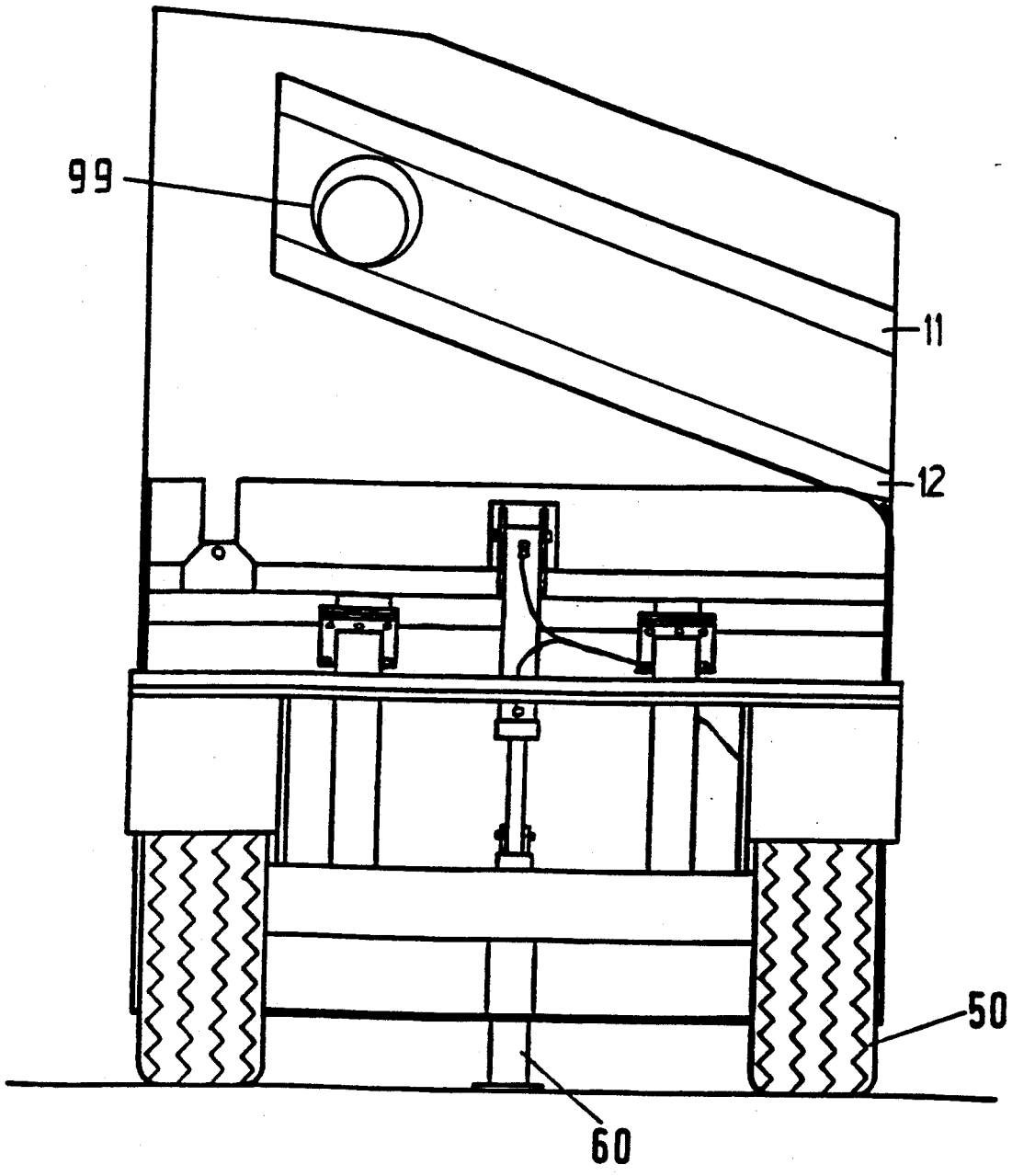
FIG. 4A schematically illustrates an agitation drive.

Referring to FIGS. 3 and 4, the angle of inclination of the screen box 10 can be altered by opening the clamps 75, one of which is shown in FIG. 3, and by operation of the hydraulic rams 80, one of which is shown in FIG. 4.

The screen box 10 comprises two upper screen frames 11 and two lower screen frames 12. Each of the screen frames 11 and 12 comprises a magazine 14 which may be removed from the box 10 for cleaning, renewal or repair purposes. Each magazine includes a screen deck 15 of the required mesh. The magazines 14 are removed by being unbolted and slid out of the box. Two persons can handle a magazine quite easily.

A conveyor 110 located underneath the screen box 10 delivers fully screened material up over the fifth wheel coupling 30. A second conveyor 120 is located at the side of the apparatus and removes second grade screened material which falls from between the screen frames 11 and 12. A third conveyor (119) removes reject material which comes down the chute 105.

The second conveyor 120 is supported in its working mode by two support arms 145 which when in use protrude laterally from the low side of the apparatus and when not in use engage against the low side of the apparatus.

As shown in FIG. 3, a chute 250 is located beneath the screen box 10 and directs screened material onto the first conveyor.

The cross-member 77 may be unbolted and removed for access thereto by the bucket of a loader (not shown).

Both the second conveyor 120 and the third conveyor can be moved from a working position to a transport position on top of the apparatus by being lifted with a loader (not shown). Support members 200 are provided on top of the apparatus which hold the second conveyor 120 in a secure position. The conveyors are driven by hydraulic motors which are coupled by connectors and hydraulic hoses which can be coupled and uncoupled as required. Although not shown in the drawings, the third conveyor can be transported on the apparatus in a similar manner.

The screen box 10 is agitated by the rotation of a shaft (99) which is mounted on an eccentric axis in order to produce the "throw" required for the screen box. A counterweight at each end is used to balance the shaft. The main length of the shaft comprises a hollow pipe which reduces the weight which is "thrown" off centre by the rotation of the shaft. Rotation of the shaft in a forward direction increases the throughput of the machine, while rotation in a reverse direction keeps the material longer on the screen. This would be required if the material is wet, etc.

I claim:

1. A mobile material screening apparatus comprising a sloped screening box mounted on an upper part of the apparatus on which material to be screened may be deposited, the screening box being sloped from a high side of the apparatus to a low side and having an open side at the low side of the apparatus so that reject material may pass over the screening box;

wheels located at a rear part of the apparatus to enable the apparatus to be moved;

means for raising the wheels from ground contact;

coupling means located at a front part of the apparatus to enable the apparatus to be coupled to a prime mover;

first conveyor means located beneath the screening box and extending from within the apparatus to the front of the apparatus to convey screened material from within the apparatus to the front thereof, wherein said first conveyor means conveys said screened material from within the apparatus to beyond and above the coupling means; and means for directing screened material from the screening box to the conveyor means.

2. A mobile screening apparatus as claimed in claim 1, in which the screening box comprises a first and a second screening frame, the first screening frame located above and spaced apart from the second screening frame thereby enabling three grades of screened material to be obtained from the apparatus, namely reject material, single screened material and double screened material, the double screened material being conveyed by said first conveyor means, and a second conveyor means is provided to convey the single screened material;

said second conveyor means being provided at the low side of the apparatus.

3. A mobile screening apparatus as claimed in claim 2, in which said second conveyor means has means for removably attaching the second conveyor means to the low side of the apparatus.

4. A mobile screening apparatus as claimed in claim 3, in which said second conveyor means has means for removably mounting the second conveyor means above said screening box for transportation.

5. A mobile screening apparatus as claimed in claim 4, in which a third conveyor means is removably attached to the low side of the apparatus and is removably mounted adjacent said second conveyor means above the screening box for transportation, said third conveyor means being used to convey reject material from the apparatus.

6. A mobile screening apparatus as claimed in claim 2, in which the first screening frame and the second screening frame comprise removable screening magazines, each magazine comprising a screen deck having a screen mesh of the required size.

7. A mobile screening apparatus as claimed in claim 1, in which said wheels are fixed relative to the apparatus and said means for raising the wheels comprises at least two hydraulic rams mounted at a lower edge of the apparatus and operable to engage the ground and thereby lift the apparatus together with said wheels.

8. A mobile screening apparatus as claimed in claim 7, in which one of said hydraulic rams is mounted at the front of the apparatus and the other of said hydraulic rams is mounted at the rear of the apparatus.

9. A mobile screening apparatus as claimed in claim 8, in which extendable legs are provided at corners of the apparatus, the extendable legs supporting the apparatus during operation.

10. A mobile screening apparatus as claimed in in claim 1, including means for adjusting the angle of the slope of said sloped screening box.

11. A mobile screening apparatus as claimed in in claim 1, in which the screening box is agitated by means of an eccentrically mounted rotatable shaft, the shaft comprising a hollow pipe over a substantial portion of its length.

12. A mobile screening apparatus as claimed in claim 11, in which the rotatable shaft is selectively rotatable in a first direction or in a second direction; rotation in either the first direction of rotation tending to keep the material on the screening box longer than the second direction of rotation, and the second direction of rotation tending to move the material on the screening box down the slope of the screening box more quickly than the first direction of rotation.

13. A mobile material screening apparatus comprising a sloped screening box mounted on an upper part of the apparatus on which material to be screened may be deposited, the screening box being sloped from a high side of the apparatus to a low side and having an open side at the low side of the apparatus so that reject material may pass over the screening box;

wheels located at a rear part of the apparatus to enable the apparatus to be moved;

means for raising the wheels from ground contact;

coupling means located at a front part of the apparatus to enable the apparatus to be coupled to a prime mover;

first conveyor means located beneath the screening box and extending from within the apparatus through one end of the apparatus to convey screened material from within the apparatus to outside the apparatus and beyond the coupling means; and means for directing screened material from the screening box to the conveyor means.

* * * * *